US005597973A

United States Patent [19]

Gladden et al.

[11] Patent Number: 5,597,973

[45] Date of Patent: Jan. 28, 1997

[54] SIGNAL TRANSMISSION FUSE

[75] Inventors: Ernest L. Gladden, Granby; Gary R. Thureson; Alvaro Zappalorti, both of Avon; Eric R. Davis, Torrington; Frank J. Lucca, Granby, all of Conn.

[73] Assignee: The Ensign-Bickford Company, Simsbury, Conn.

[21] Appl. No.: 380,839

[22] Filed: Jan. 30, 1995

[51] Int. Cl.[6] ..... C06B 45/00; C06C 5/06

[52] U.S. Cl. ..... 102/289; 102/292; 102/275.8; 102/275.9; 102/275.11

[58] Field of Search ..... 102/289, 292, 102/275.8, 275.9, 275.11

[56] References Cited

U.S. PATENT DOCUMENTS

| | | | |
|---|---|---|---|
| 3,590,739 | 7/1971 | Persson | 102/27 |
| 4,328,753 | 5/1982 | Kristensen et al. | 102/275.5 |
| 4,607,573 | 8/1986 | Thureson et al. | 102/275.8 |
| 4,838,165 | 6/1989 | Gladden et al. | 102/275.8 |
| 5,166,470 | 11/1992 | Stewart | 102/275.5 |
| 5,208,419 | 5/1993 | Greenhorn et al. | 102/275.4 |
| 5,212,341 | 5/1993 | Osborne et al. | 102/275.8 |
| 5,243,913 | 9/1993 | Brent et al. | 102/275.8 |
| 5,351,618 | 10/1994 | Brent et al. | 102/275.8 |

FOREIGN PATENT DOCUMENTS

| | | |
|---|---|---|
| 2107022 | 4/1994 | Canada . |
| 0327219 | 8/1989 | European Pat. Off. . |

*Primary Examiner*—Peter A. Nelson
*Attorney, Agent, or Firm*—Victor E. Libert

[57] ABSTRACT

A signal transmission fuse (10, 20) such as shock tube has an outside diameter (OD) not greater than about 2.380 mm (0.0937 inch), for example, a tube outside diameter (OD) of from about 0.397 to 2.380 mm (about 0.0156 to 0.0937 inch), and the ratio of the inside diameter (ID) of the tube to the radial thickness of the tube wall (T) is from about 0.18 to 2.5. The inside diameter (ID) of the tube may be from about 0.198 to 1.321 mm (about 0.0078 to 0.0520 inch). The powder surface density of the reactive material contained within the bore (16, 30) of the fuse (10, 20) may, but need not, be significantly less than that which the prior art considers to be a minimum acceptable powder surface density. Other things, such as the cost of the material used being equal, signal transmission fuse (10, 20) of the present invention is lower in cost than conventional standard sized fuse because of its reduced diameter, and yet has good stiffness and tensile strength so as to enable it to be successfully deployed and used in the same manner as standard size signal transmission fuse.

16 Claims, 1 Drawing Sheet

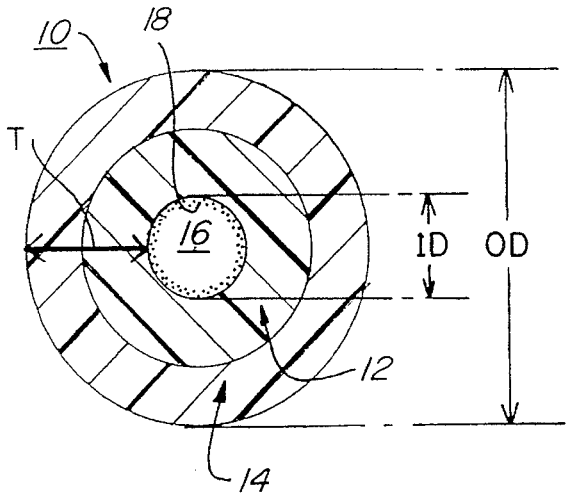
FIG. 1
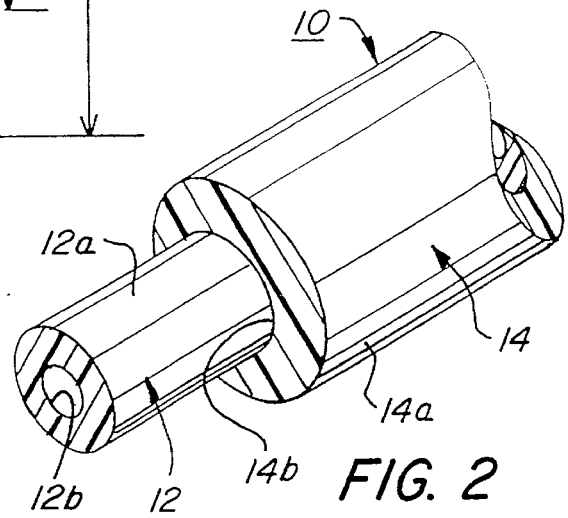
FIG. 2
FIG. 1A
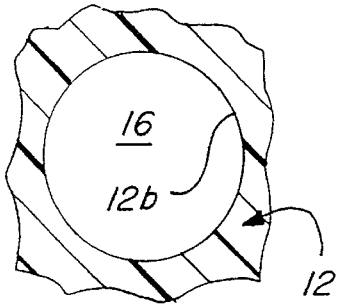
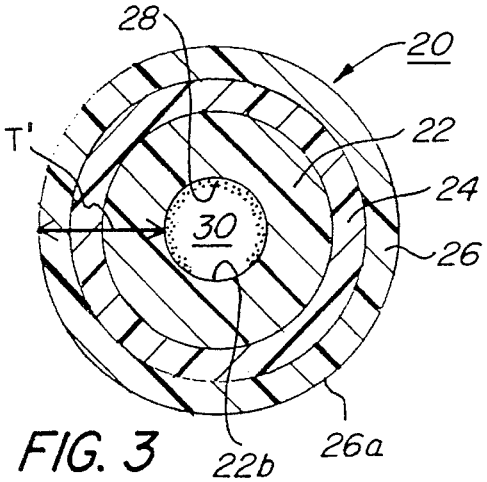
FIG. 3
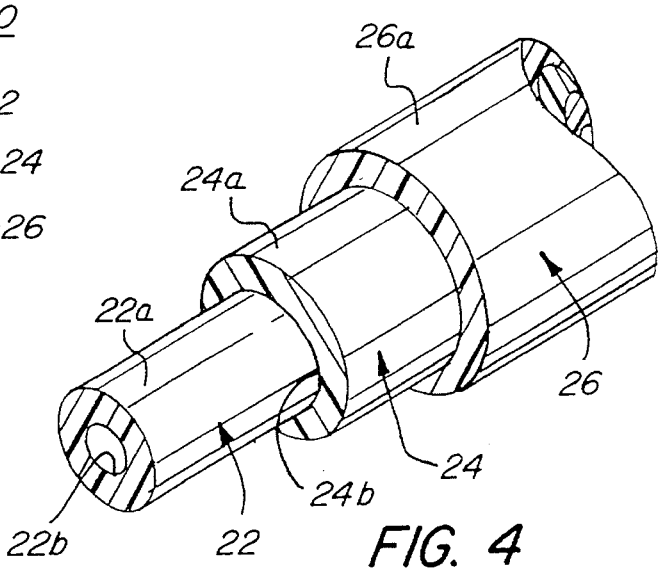
FIG. 4

SIGNAL TRANSMISSION FUSE

BACKGROUND OF THE INVENTION

1. Field of the Invention

The present invention relates to an improved signal transmission fuse such as shock tube, of the type used for transmitting a detonation signal, and more particularly to an improved construction of such fuse.

2. Description of Related Art

Signal transmission fuses of the type commonly referred to as shock tube are well-known in the art. U.S. Pat. No. 3,590,739 issued Jul. 6, 1971 to Per-Anders Persson discloses a hollow elongated plastic tube having a pulverulent reactive substance, which may be constituted by a highly brisant explosive such as PETN, RDX, TNT or HMX, adhered in one manner or another to the interior wall of the shock tube.

U.S. Pat. No. 4,328,753 issued May 11, 1982 to L. Kristensen et al discloses a shock tube, described as a low energy fuse, in the form of a plastic tube comprised of concentric tubular plies of material. The inner or sub-tube is made of a polymeric material, such as an ionomeric plastic of the type sold under the trademark SURLYN by E. I. Du Pont Company, to which a pulverulent reactive material will cling. The sub-tube is surmounted by an outer tube made of a mechanically tougher material such as a polyamide, polypropylene, polybutene or other such polymer having satisfactory mechanical properties to withstand the stresses of deploying the fuse on a work site. The reactive material is a powdered mixture of an explosive such as cyclotetramethylene tetranitramine (HMX) and aluminum powder. The Patent discloses (column 2, line 1 et seq. and line 28 et seq.) that for a plastic tube having an outer diameter of 3 millimeters and an inner diameter of 1.3 millimeters, there should be a core loading of at least 2.7 grams of reactive material per square meter of the inner surface of the tube in order to insure that the requisite shock wave is transmitted through the tube upon initiation. It is disclosed as an advantage that the adhesive sub-tube permits the coating of reactive material to attain a core loading of up to about 7 grams per square meter of the inner surface of the tube (column 2, lines 64–66).

U.S. Pat. No. 4,607,573 issued Aug. 26, 1986 to G. R. Thureson et al discloses a laminated fuse comprising two or more laminated layers of material and a method of making the same including elongating the sub-tube after application of the pulverulent reactive material to the interior thereof to reduce both the wall thickness of the sub-tube and the loading thereon of reactive material per unit length ("core load"). An outer coating is applied to the outer surface of the elongated sub-tube to extend coextensively therewith and thereby provide a laminated tube having the layers thereof bonded securely to each other. Generally, the Thureson et al Patent discloses (column 3, line 9 et seq.) that the inner tube will have an average inside diameter of 0.017 to 0.070 inch (0.432 mm to 1.778 mm) and an outside diameter of 0.034 to 0.180 inch (0.864 mm to 4.57 mm) and an outer coating or layer applied over the inner or sub-tube. The Examples starting at column 5 of the patent show finished tubes (the inner or sub-tube with the overlying sheath or sheaths) having an outside diameter ("OD") of 0.150 inch (3.810 mm) and an inside diameter ("ID") of 0.051 inch (1.295 mm) in Example 1. Examples 2 and 3 each show a tube having a 0.118 inch (2.997 mm) OD and, respectively, 0.040 inch (1.016 mm) and 0.041 inch (1.041 mm) ID.

U.S. Pat. No. 5,212,341 issued May 18, 1993 to A. M. Osborne et al discloses multiple-layer, co-extruded shock tube having an inner layer or ply (sub-tube) having a thickness of less than 0.3 millimeter. It is stated that by making the sub-tube so thin a savings is effectuated by reducing the quantity of the more expensive (as compared to the material of the outer tube) material of which the powder-adherent inner tube is made. The Osborne et al patent, as does the above-mentioned U.S. Pat. No. 4,328,753, discloses at column 2, line 60 et seq., that at least 2.7 grams of reactive material per square meter of the tube inner surface is desired and the Examples at columns 3–4 disclose a tube having an outside diameter of 3.0 mm and an inside diameter of 1.1 mm (Example 1) and a tube having an outside diameter of 3.0 mm and an inside diameter of 1.2 mm (Example 2).

SUMMARY OF THE INVENTION

In accordance with the present invention there is provided a signal transmission fuse comprising the following components. A tube of synthetic polymeric material has a tube wall defining a tube outer surface and a tube inner surface, the tube inner surface defining a bore which extends through the tube and contains a reactive material dispersed within and extending along the length of the bore. The tube has an outside diameter not greater than about 2.380 mm (0.0937 inch) and the ratio of the inside diameter of the tube to the thickness of the tube wall is from about 0.18 to 2.5, e.g., from about 0.83 to 1.33.

One aspect of the invention provides for a tube outside diameter of from about 0.397 to 2.380 mm (about 0.0156 to 0.0937 inch) and a tube inside diameter of from about 0.198 to 1.321 mm (about 0.0078 to 0.0520 inch), e.g., a tube outside diameter of from about 1.90 to 2.36 mm (about 0.075 to 0.093 inch) and a tube inside diameter of from about 0.51 to 0.86 mm (about 0.020 to 0.034 inch).

Another aspect of the present invention provides that the reactive material is a pulverulent mixture of a fuel selected from the class consisting of a mixture of aluminum and an explosive material selected from the class consisting of HMX, PETN, RDX, 2,6-bis(picrylamino)-3,5-dinitropyridine and ammonium perchlorate. Such reactive material may be dispersed within the bore at a powder surface density of from about 0.45 to 7 grams of reactive material per square meter of tube inner surface ("$g/m^2$"). For example, in a specific aspect of the invention, the reactive material may comprise 75 to 95 parts by weight HMX and 25 to 5 parts by weight aluminum and may be dispersed within the bore at a suitable powder surface density, e.g., a powder surface density of from about 1.4 to 7 $g/m^2$. (The term "powder surface density" is defined below.) Alternatively, a powder surface density of reactive material of less than about 2.7 $g/m^2$, e.g., from about 0.45 to 2.65 $g/m^2$ may be employed. Any suitable reactive material may be employed, e.g., a pulverulent mixture of aluminum and HMX is a suitable reactive material.

Yet another aspect of the present invention provides for the tube wall to be comprised of a plurality of concentrically disposed sandwiched tubular plies, including an outermost ply having an outer wall which defines the tube exterior surface, an innermost ply having an inner wall which defines the tube inner surface and, optionally, one or more intermediate plies sandwiched between the innermost ply and the outermost ply.

Still another aspect of the present invention provides for an intermediate ply which serves as a tie-layer and is in contact with both of, and bonds together, inner and outer plies immediately adjacent to the tie-layer on either side thereof, e.g., the innermost and outermost plies. The tie-layer may comprise a blend of the polymers of which the bonded, e.g., innermost and outermost, plies are made.

As used herein and in the claims, the following terms shall have the indicated meanings.

The term "signal transmission fuse" shall mean a hollow plastic (polymer) tube having a reactive material on the interior surface thereof and being suitable for use in transmitting a detonation signal through the fuse by ignition of the reactive material. The defined term embraces shock tubes of the type disclosed in U.S. Pat. Nos. 4,328,753 and 4,607,573, low velocity signal transmission tubes of the type disclosed in U.S. Pat. No. 5,257,764, and impeded velocity signal transmission tubes of the type disclosed in U.S. Pat. No. 4,838,165.

The term "powder surface density" means the quantity of pulverulent reactive material per unit area of the inner surface of the signal transmission fuse and is expressed herein and in the claims as grams of reactive material per square meter of tube inner surface area, such units being abbreviated as "$g/m^2$". The terms "linear core load" is sometimes used herein to express the quantity of pulverulent reactive material per unit length of the signal transmission tube and is expressed herein in milligrams of reactive material per linear meter of signal transmission fuse, such units being abbreviated herein as "mg/m". It will be appreciated that transmission fuses with identical core loadings may have different powder surface densities if their respective inside diameters are different.

The term "millimeter" is abbreviated herein as "mm" and the term "centimeter" as "cm".

Other aspects of the invention will become apparent from the following description and the drawings appended hereto.

BRIEF DESCRIPTION OF THE DRAWINGS

FIG. 1 is a cross-sectional view of one embodiment of a signal transmission fuse in accordance with the present invention;

FIG. 1A is a view, enlarged with respect to FIG. 1, of the bore and adjacent tube inner surface of the signal transmission fuse of FIG. 1;

FIG. 2 is a perspective view with parts broken away of a longitudinal segment of the signal transmission fuse of FIG. 1;

FIG. 3 is a view similar to that of FIG. 1 showing another embodiment of the signal transmission fuse of the present invention; and FIG. 4 is a perspective view with parts broken away of a longitudinal segment of the signal transmission fuse of FIG. 3.

DETAILED DESCRIPTION OF THE INVENTION AND PREFERRED EMBODIMENTS THEREOF

Generally, the signal transmission fuses of the present invention comprise hollow plastic tubing having a reactive material dispersed on the walls of the hollow interior passage or bore extending through the tube, i.e., on the tube inner surface. The signal transmission fuse may comprise shock tubes in which the reactive material comprises a pulverulent fuel such as powdered aluminum and a highly brisant explosive powder such as HMX. Alternatively, the signal transmission fuse may comprise low velocity or impeded velocity signal transmission tubes in which the reactive material comprises a deflagrating material such as silicon/red lead, molybdenum/potassium perchlorate, boron/red lead or one or more of many other such deflagrating materials, as are known in the art and taught in U.S. Pat. No. 4,838,165 issued Jun. 13, 1989 to E. L. Gladden et al and U.S. Pat. No. 4,757,764 issued Jul. 19, 1988 to G. R. Thureson et al. In such impeded velocity or low velocity signal transmission tubes, the signal is transmitted through the tube at a considerably lower velocity, typically about 330 meters per second, than the approximately 2,000 meters per second signal transmission speed of shock tube. Otherwise, the construction and uses of shock tube and impeded and low velocity signal transmission tubes are similar or identical to each other.

During deployment, signal transmission fuses are subject to high tensile stresses, to cuts and abrasions on rocks, stone and the like, and to kinking if the tube is insufficiently stiff. As will be noted from the above-described prior art, the art is concerned with providing both an innermost ply or sub-tube which is capable of retaining adhered thereto, and reducing migration of, pulverulent reactive material, and an outermost ply or outer tube which will provide sufficient mechanical toughness, stiffness and tensile strength to withstand deployment of the shock tube at blasting sites. Advantageously, at least one of the plies should also be impervious to water and oil because in use the signal transmission fuse is often exposed to ground water and rain and is often used to detonate explosive mixtures comprising emulsions, mixtures of fuel oil and ammonium nitrate, etc. The art is also aware of the cost factor involved in attaining this desirable combination of properties, as evidenced by the above-described Osborne et al U.S. Pat. No. 5,212,341 which teaches extruding the sub-tube as a thin-wall tube in order to reduce material costs of the sub-tube and thereby enable the provision of a heavier and tougher outer tube at acceptable cost. Despite its concern with costs, in order to provide desired bulk, toughness and tensile strength, the prior art has been constrained to provide a relatively large outer diameter tube ranging from about 0.118 to 0.150 inch (2.997 mm to 3.810 mm) outside diameter. Further, the art is also concerned with providing reliable initiation and propagation of the ignition signal within the signal transmission fuse, and to this end, as noted in the above-mentioned Kristensen et al and Osborne et al Patents, a reactive material core loading of at least 2.7 grams per square meter of surface area of the tube inner surface was considered essential by the prior art.

The present invention moves away from the teachings of the prior art in providing a signal transmission fuse of smaller outside diameter than taught in the art, not greater than about 0.094 inch (2.388 mm) and one which optionally may employ a core loading of reactive material less than the 2.7 $g/m^2$ deemed to be necessary by the prior art at least in cases where axial ignition (defined below) of the shock tube is to be employed. As a result, significant cost savings are achieved, primarily because of the reduction in plastic material required per unit length of signal transmission fuse. The reduction in reactive material used per unit length of signal transmission also reduces costs, but that is a much less significant cost factor than the savings in plastic tubing, especially the usually expensive plastic from which the sub-tube is made. Manufacture of the reduced-diameter fuse of the invention is also more efficient and therefore less costly because the smaller cross section of the fuse permits higher extrusion and line speeds. The reduced-diameter fuse of the present invention also attains significant savings in shipping and storage costs because volume requirements for shipment and storage are greatly reduced inasmuch as coils of the fuse of the invention are much less bulky than coils of the same length of standard size fuse. Easier handling and deployment of the signal transmission fuse at the job site is also attained because, despite its reduced diameter, the signal transmission fuse of the present invention utilizes a ratio of the inside diameter of the tube to the thickness of the tube wall which is selected to provide enough stiffness to avoid kinking of the tube while it is being handled and deployed. If the signal transmission fuse is insufficiently stiff, it will kink, i.e., sharp bends will be formed in it which can choke off the interior bore of the tube and preclude reliable transmission of the signal. Other advantages of the reduced-diameter signal transmission fuse of the invention include enhanced sensitivity to initiation by low energy detonating cords or other igniters placed externally to the signal transmission fuse. Enhanced retention of the reactive material powder within the tube is also attained by the practices of the present invention, that is, there is a lesser tendency, as compared to the conventional larger-diameter signal transmission fuses, for the pulverulent reactive material to migrate, a problem well-known to those skilled in the art as shown by the above-mentioned Kristensen et al Patent. The migration of reactive material powder tends to result in the loose powder accumulating in places where the signal transmission fuse is bent or looped or within devices such as detonator caps to which the signal transmission fuse is connected.

Despite its reduced diameter, the signal transmission fuse of the present invention, by judicious selection of materials of construction, can be made to have tensile strength and abrasion resistance characteristics at least as good as the significantly larger-diameter fuses of the prior art. The fuses of the present invention also provide enhanced radial initiation sensitivity. For example, that advantage has been found to be attainable without the necessity of using more expensive, high powder-retention materials such as SURLYN® 9020 resin (formerly designated SURLYN® 1855 resin by the manufacturer) for fabrication of the inner ply or sub-tube.

The following description will refer specifically to shock tube but it will be appreciated that the same materials (except for the reactive material) and construction are applicable to signal transmission tube fuses generally, i.e., shock tubes, impeded velocity and low velocity signal transmission tubes.

Referring now to FIGS. 1 and 2 there is shown therein a shock tube 10 comprised of a tubular innermost ply 12 which constitutes a sub-tube and a tubular outermost ply 14 which constitutes an outer tube or sheath. Plies 12 and 14 are sandwiched together, that is, the inner surface 14*b* (FIG. 2) of outermost ply 14 is in full face-to-face contact with the outer surface 12*a* (FIG. 2) of innermost ply 12. The sandwiched plies may be adherently bound to each other, for example, by utilizing the manufacturing technique disclosed in Thureson et al U.S. Pat. No. 4,607,573, discussed above, wherein the outermost ply is extruded or otherwise applied over the innermost ply while the latter is maintained in a stretched condition, the stretching tension being released only after application of the outer tube to the sub-tube. Alternatively, or in addition, an adhesive or tie-layer may be formed, for example, co-extruded, between adjacent plies, as discussed below. In any case, plies 12 and 14 cooperate to define a tube having a tube wall whose thickness is defined by the combined radial thicknesses (dimension T in FIG. 1) of the walls of plies 12 and 14. The tube wall, more specifically, outermost ply 14 thereof, defines a tube outer surface 14*a* (FIG. 2) and, as seen in FIG. 1A, the tube wall, more specifically, innermost ply 12 thereof, defines a tube inner surface 12*b*. (Reactive material 18, shown in FIG. 1 and described below, has been omitted from FIG. 1A for enhanced clarity of illustration.) Outermost ply 14 has an inner surface 14*b* (FIG. 2) and innermost ply 12 has an outer surface 12*a*. Innermost ply 12 is received within outermost ply 14 to provide (FIG. 2) face-to-face contact between outer surface 12*a* and inner surface 14*b*.

A bore 16 extends through shock tube 10, is defined by the tube inner surface 12*b*, and defines the inside diameter ID of tube 10. A pulverulent reactive material 18, the thickness of which is greatly exaggerated in FIG. 1 for clarity of illustration, adheres to the tube inner surface 12*b* along substantially the entire length of bore 16. Generally, the outside diameter OD of shock tube 10 is not greater than about 2.380 mm (0.0937 inch) and the ratio of the inside diameter ID to the thickness T of the tube wall is from about 0.18 to 2.5, preferably, from about 0.83 to 1.33. The outside diameter OD of shock tube 10 may range from about 0.397 to 2.380 mm (about 0.0156 to 0.0937 inch) and the inside diameter ID may range from about 0.198 to 1.587 mm (about 0.0078 to 0.0625 inch).

Shock tube 10 may be made of any suitable material and preferably is made of suitable synthetic organic polymeric (plastic) materials within which a suitable reactive material 18 is disposed. Thus, in one embodiment, innermost ply 12 may be made of an ionic polymer such as any suitable grade of polymer sold under the trademark SURLYN® by E. I. Du Pont Company or it may be made of a material such as ethylene acrylic acid, for example, that sold under the trademark PRIMACOR™, especially PRIMACOR™ 1410, manufactured by The Dow Chemical Company. Outermost ply 14 may be made of polyethylene, such as a low density or medium density polyethylene, a polyamide such as nylon, or polyurethane or a polyether block amide polymer such as that sold under the trademark PEBAX™, such as PEBAX™ 7033, manufactured by Elf Atochem Company. One combination which has been successfully tested is a shock tube in which innermost ply 12 is made of PRIMACOR™ 1410 polymer and outermost ply 14 is made of PEBAX™ 7033 polymer. The tested shock tube employed a reactive material 18 comprising a pulverulent mixture of HMX and aluminum powder in a weight ratio of 87 parts HMX to 13 parts of aluminum with the reactive material provided at a linear core load of 12.6 milligrams per linear meter ("mg/m") of shock tube 10, equivalent to a powder surface density of 5.64 g/m$^2$ for the tested shock tube. The tested shock tube had an inside diameter ID of 0.711 mm (0.0280 inch) and a wall thickness T of 0.724 mm (0.0285 inch) for a ratio of ID to T of 0.98.

Referring now to FIG. 3, there is shown another embodiment of the invention comprising a shock tube 20 having a sub-tube comprised of a tubular innermost ply 22, a tubular intermediate ply 24 and an outer sheath comprised of a tubular outermost ply 26. The tube wall, more specifically, outermost ply 26 thereof, defines a tube outer surface 26*a* (FIG. 4) and innermost ply 22 defines a tube inner surface 22*b* on which is dispersed a reactive material 28. (A portion of the reactive material 28 has been omitted in FIG. 3 to better show the tube inner surface 22*b*.) As shown in FIG. 4, innermost ply 22 has an outer surface 22*a* and tubular intermediate ply 24 has an outer surface 24*a* and an inner surface 24*b*. A bore 30 (FIG. 3) extends through shock tube 20 and is defined by the tube inner surface 22*b* and defines the inside diameter of shock tube 20. As in the illustration of FIG. 1, the thickness of reactive material 28 is greatly exaggerated in FIG. 3 and, as noted above, a portion thereof is omitted, for clarity of illustration. The wall thickness of shock tube 20 is comprised of the combined radial wall thicknesses of plies 22, 24 and 26 and is indicated in FIG.

3 by dimension line T'. Dimension lines to illustrate the inside and outside diameters of shock tube 20 have been omitted from FIG. 3 but would correspond to those illustrated in FIG. 1.

In one embodiment, as illustrated by FIG. 3, tubular intermediate ply 24 could be comprised of a material which is adherent to both the materials of innermost ply 22 and outermost ply 26 and thereby serve as a tie-layer. Tie-layers may also be utilized as very thin layers between adjacent plies 22 and 24 and/or between adjacent plies 24 and 26. A similar tie-layer may of course also be used between plies 12 and 14 of the embodiment of FIG. 1. Such tie-layers may, but need not necessarily, be extremely thin relative to the wall thickness of the bound plies, serving in effect as adhesive layers which tend to bind together each of the two plies ("the bound plies") immediately adjacent to the tie-layer, thereby enhancing the tensile strength of the signal transmission fuse and/or reducing tendency of the tube to kink during handling and deployment. For example, the material of tubular innermost ply 22 may have been selected primarily for its property of having the pulverulent reactive material 28 cling thereto without excessive migration of the reactive material 28. However, it may be that ply 22 is not adherent to or bondable with the material from which tubular outermost ply 26 is made. On the other hand, ply 26, although not readily bondable to ply 22, may have the advantageous property of resistance to water and oil, scuffing and abrasion. In such case, it may be advantageous to select the material or materials from which tubular intermediate ply 24 is made from those which are bondable with the materials from which both innermost ply 22 and outermost ply 26 are made. Such bonding may be attained either directly between plies 22 and 24 and between plies 24 and 26, or by interposition of an intermediate adherent layer (interposed between plies 22 and 24 and/or between plies 24 and 26). Intermediate ply 24 may have a relatively large wall thickness, comparable to the wall thicknesses of plies 24 and 26 as illustrated in FIG. 3, in cases where the material from which intermediate ply 24 is made has, in addition to its bonding properties, properties which enhance the strength and/or stiffness of the shock tube 20. On the other hand, the adherent or tie-layer may be selected primarily for its adhesive or bonding qualities to the material of both the plies adjacent to it, i.e., the bound plies, and in such case the wall thickness of the tie-layer may be extremely small compared to that of the bound plies to yield a structure which would look more like that illustrated in FIG. 1, with only a thin, adhesive tie-layer formed between plies 12 and 14.

As described in more detail in co-pending patent application Ser. No. 08/561,615 entitled SIGNAL TRANSMISSION TUBE USING RECLAIM MATERIAL AND METHOD OF MANUFACTURE, an intermediate adhesive or tie-layer may be included in the structure of FIG. 1 by utilizing recycled shock tube production. For example, during start-up of a line before steady operating conditions are attained or during upset conditions, unusable extruded plastic, or signal transmission fuse product which has a core loading or other characteristics other than those which are desired, may be produced. Instead of discarding such plastic and unusable product, which incurs significant costs both because of the waste of material and the necessity of disposing of it in an environmentally sound and safe manner, the reactive material, if any, of such unusable signal transmission fuse product may be removed by any suitable means to inactivate the product, and the resulting fuse carcass, together with unusable extruded plastic, may be recyled. Such recycling may be attained by grinding the extruded plastic and fuse carcass into a particulate mass which will of course comprise, in the case of shock tube 10 of FIG. 1, a mixture of the materials from which plies 12 and 14 are made. This mixture may then be extruded to form an intermediate tie-layer or coating between plies 12 and 14 and, as such coating contains a mixture of substantial quantities of the materials from which both plies 12 and 14 are made, such intermediate tie-layer will bond or adhere to each of plies 12 and 14 even when those plies are made of materials which do not bond or adhere well to each other.

It will be appreciated that although multi-ply transmission fuses are illustrated in the Figures and described in connection with certain embodiments of the invention, the reduced-diameter transmission fuses of the present invention may also be embodied in monotube fuses, that is, fuses comprising a single ply tube.

Generally, the powder surface density that is suitable or required for the transmission fuse in a given case will depend on a number of factors including the mode of ignition of the transmission fuse. Thus, if the transmission fuse, e.g., shock tube, is to be initiated axially through an open end of the tube as by a spark ignition device, reliable ignition is attainable with low powder surface densities. Such ignition of a transmission fuse through an open end thereof is sometimes referred to as "axial" ignition or initiation or carrying out the same "axially". On the other hand, if the transmission fuse is to be ignited externally of the transmission fuse through the intact tube wall thereof, generally higher powder surface densities are required. Such ignition of transmission fuse may be carried out by placing detonating cord or the explosive end of a detonator cap in close proximity to, and preferably in abutting contact with, the exterior wall of the transmission fuse. Such ignition or initiation of a transmission fuse is referred to as "radial" or "radial through-wall" ignition or initiation or carrying out the same "radially". The reliability of radial through-wall initiation will depend on the explosive strength of the detonating cord, detonator cap or other device utilized and the characteristics of the transmission fuse. The latter include the tube wall thickness, the materials of construction of the tube, the composition of the reactive material and the powder surface density of the transmission fuse being initiated. Reliability of initiation of shock tube by the radial through-wall method is of course enhanced by increasing the strength of the detonating cord, detonator cap or other device used to effectuate such initiation. However, countervailing considerations exist, such as safety and the reduction of noise, blast and generation of shrapnel of transmission fuse setups, especially those placed on the surface of the ground. These countervailing considerations dictate the use of detonating cords, detonator caps, etc., of as low explosive strength as possible consistent with reliable initiation of the transmission fuse. The enhanced sensitivity to initiation of the reduced diameter shock tube of the present invention as described herein is therefore advantageous as it provides reliable initiation with low energy initiating devices.

The following examples illustrate the efficacy of certain embodiments of the present invention.

EXAMPLE 1

In order to test the ignition sensitivity of reduced-diameter shock tube, a three-ply shock tube as illustrated in FIGS. 3 and 4 was manufactured with a 2.11 mm (0.083 inch) OD and a 0.79 mm (0.031 inch) ID. The innermost ply (22 in FIGS. 3 and 4) was made of SURLYN® 8941 polymer and had a radial wall thickness of 0.312 mm (0.0123 inch), the intermediate ply (24 in FIGS. 3 and 4) was made of PRIMACOR™ 1410 ethylene acrylic acid polymer and had a radial wall thickness of 0.066 mm (0.0026 inch), and the outermost ply (26 in FIGS. 3 and 4) was made of PEBAX™ 6333 polymer and had a radial wall thickness of 0.282 mm (0.011 inch). As the tubular innermost ply was being extruded it was initially maintained in a vertical orientation and the reactive material, consisting of a powdered mixture of HMX and aluminum in a weight ratio of 89.5 parts HMX and 10.5 parts aluminum, was introduced therein into the relatively large diameter parison from which the innermost ply or sub-tube was being drawn. The reactive material was introduced in quantities to provide a powder surface density in the finished product of 4.7 g/m$^2$. After the reactive material was fed into the extruding innermost ply or sub-tube, the outermost ply was then extruded over the innermost ply to provide a shock tube designated as Sample 8A.

Shock tube Sample 8A was tested for ignition sensitivity to radial through-wall initiation, by contacting lengths of Sample 8A shock tube with low-energy detonating cord of the type sold under the trademark PRIMALITE® by The Ensign-Bickford Company. PRIMALITE® detonating cord is a dry-spun detonating cord containing a solid core of PETN. Contacting the detonating cord with the shock tube to be sampled was accomplished by placing a length of the sample shock tube on a hard, flat anvil surface and placing a length of the detonating cord over the shock tube and positioned perpendicularly thereto. At the point where the detonating cord contacted the shock tube, the sample shock tube lengths were covered with a selected number of tight wraps of SCOTCH® brand tape, No. 810, manufactured by the 3M Company. This SCOTCH® brand tape is 0.002 inch (0.051 mm) thick. The PRIMALITE® detonating cord was held in contact under pressure with the tape-wrapped section of the shock tube by placing a steel bar atop the detonating cord at its junction with the shock tube. The steel bar was supported at a fulcrum point so as to provide a uniform weight of about one pound (0.45 kg) pressing the detonating cord into firm contact with the shock tube. The detonating cord was then initiated to determine the number of wraps of SCOTCH® brand tape at which the shock tube would be initiated in fifty percent of the attempts. This procedure was used for all the tests. In the tests, reduced diameter shock tube in accordance with one embodiment of the present invention was compared to commercially available standard size two-ply shock tube of 0.118 inch (3.00 mm) outside diameter, 0.045 inch (1.143 mm) inside diameter and comprising an innermost ply (12 in FIGS. 1 and 2) which was made of SURLYN® 8941 polymer and had a radial wall thickness of 0.330 mm (0.013 inch) and an outermost ply which was made of medium density polyethylene and had a radial wall thickness of 0.584 mm (0.023 inch). The results of the testing are summarized in TABLE I.

TABLE I

| PRIMALITE ® Det. Cord | | Shock Tube Sample 8A | | Comparative Standard Shock Tube | |
|---|---|---|---|---|---|
| gr/ft[1] | % Δ[2] | Wraps[3] | % Δ[2] | Wraps[3] | % Δ[2] |
| 5.1 | — | 4.0 | — | 2.4 | — |
| 5.8 | 14[4] | 9.0 | 125 | 4.0 | 67 |
| 7.9 | 36 | 16.1 | 79 | 9.8 | 145 |

[1]The PETN content of the detonating cord is expressed in grains of PETN per linear foot of cord ("gr/ft").
[2]% Δ = the percentage change as compared to the immediately preceding entry in the TABLE rounded to the nearest whole number. See footnote[4] for an illustration.
[3]Wraps = the average number of wraps of SCOTCH ® brand No. 810 tape tightly wrapped around the sample shock tube at its junction with the PRIMALITE ® detonating cord, at which the shock tube sample was initiated in fifty percent of the attempts.
[4]The % Δ for 5.8 gr/ft as compared to 5.1 gr/ft is calculated as % Δ = 5.8 − 5.1) 100/5.1 = 14%.

It will be noted from TABLE I that the reduced-diameter shock tube of Sample 8A is about at least 67% more easily radially initiated by the 5.1 gr/ft detonating cord than is the standard comparative shock tube. This is calculated as follows: (4.0–2.4 wraps)100/2.4 wraps=67%. This improved sensitivity applies across the range of different strengths of detonating cord tested. Thus, using a 5.8 gr/ft detonating cord, %Δ for 9.0 versus 4.0 wraps is and a 7.9 gr/ft detonating cord yields a %Δ of 64% for 16.1 versus 9.8 wraps. Also, it is interesting to note that the PETN load increase of the detonating cord from 5.1 to 5.8 and 5.8 to 7.9 represents 14% and 36% increases respectively, whereas the change in initiation sensitivity changed 125% and 79% respectively for Sample 8A reduced-diameter shock tube and 67% and 145% respectively for standard shock tube. The small change in the PETN load of the PRIMALITE® donor detonating cord leads to a very large percentage increase in the ability to initiate the two types of shock tube, and the difference is further amplified with reduced-diameter Sample 8A tube as compared to standard shock tube. This improvement with reduced-diameter shock tube is unanticipated.

EXAMPLE 2

In order to demonstrate the improved or equivalent performance in terms of physical properties of the reduced-diameter signal transmission fuse of the present invention as compared with conventional, or larger diameter shock tube, a reduced-diameter shock tube and a standard shock tube were prepared as follows.

(1) A three-ply reduced-diameter shock tube as illustrated in FIGS. 3–4 was manufactured by extruding the tube at a rate of 2000 feet per minute with a 2.16 mm (0.085 inch) OD and a 0.69 mm (0.027 inch) ID. The outermost ply (26 in FIGS. 3 and 4) was made of PEBAX™ 6333 polymer and had a radial wall thickness of 0.335 mm (0.0132 inch), the intermediate tie-layer (24 in FIGS. 3 and 4) was made of PRIMACOR™ 1410 ethylene acrylic acid polymer and had a radial wall thickness of 0.0635 mm (0.0025 inch), and the innermost ply (22 in FIGS. 3 and 4) was made of SURLYN® 8941 ionomer and had a radial wall thickness of 0.338 mm (0.0133 inch).

(2) A three-ply standard diameter shock tube of the type illustrated in FIGS. 3 and 4 was manufactured by extruding the tube at a rate of 1368 feet per minute with a 3 mm (0.118 inch) OD and a 1.14 mm (0.045 inch) ID. The outermost ply (26 in FIGS. 3 and 4) had a radial wall thickness of 0.510 mm (0.0201 inch); it and the intermediate tie-layer (24 in FIGS. 3 and 4) were made of linear low density polyethylene, and the intermediate tie-layer had a radial wall thickness of 0.071 mm (0.0028 inch). The innermost ply (22 in FIGS. 3 and 4) was made of SURLYN® 8941 ionomer and had a radial wall thickness of 0.337 mm (0.0133 inch).

(3) The shock tubes of both (1) and (2) were manufactured with the same reactive material composition consisting of 10.5% by weight aluminum powder and 89.5% by weight HMX powder. Both shock tubes (1) and (2) were manufactured by the same method as in Example 1, except that both the outermost ply and the intermediate tie-layer were simultaneously co-extruded over the innermost ply.

A. Tensile Strength and Elongation

The shock tubes of both (1) and (2) were tested for tensile strength at break and elongation at break on a Instron Tensile Machine using a 4-inch (10.16 cm) gauge length at a 10 inch per minute (25.4 cm per minute) strain rate. Three 8-inch (20.32 cm) samples of each type were tested and averaged. The reduced-diameter shock tube in accordance with an aspect of the present invention had higher tensile strength at break (45 pounds or 20.4 kilograms) than the comparative standard shock tube (38 pounds or 17.2 kilograms) and lesser, although comparable, elongation at break (230% versus 290%).

B. Impact Resistance

Impact resistance was determined on a Technoproducts Model 7 Drop Weight Tester, comprising a steel base and anvil, and a chisel tip impact head having a flat blade tip about 0.021 inch (0.533 mm) in width. The total weight of the fixture dropped on the samples was about 2.2 pounds (1 kilogram). Twenty-five tube samples were cut to approximately 1½ inches (3.81 cm) in length, and the samples were systematically impacted with the drop weight tester using incremental height changes of 0.5 cm for the drop. A failure was defined as total separation of the tube after impact. Calculations produced the impact height at which 50% of the samples will fail, as reflected in TABLE II below.

C. Oil Permeation Resistance

Samples of the reduced-diameter and comparative standard shock tubes were subjected to an oil permeation resistance test to evaluate the relative resistance of the respective tube structures to diesel fuel ingress through the tube wall. Oil-exposure conditions are encountered by shock tube used in the field by being emplaced within a bore hole containing an emulsion, slurry or ANFO (ammonium nitrate-fuel oil mixture, such as a mixture of ammonium nitrate with 6% fuel oil). Five 10-foot (3 meter) samples with both ends of the shock tube heat sealed closed were prepared for both types (reduced diameter and standard comparative) of shock tube being tested. Sets of these shock tube samples from (1) and (2) of this Example were immersed in a 1 gallon stainless steel beaker which was filled ¾ full with a winterized diesel fuel (a mixture of 80% standard #2 diesel fuel and 20% kerosene). The heat sealed ends of the shock tube coils were kept outside of the stainless steel beaker. The top of the beaker was closed with a barrier bag (Aluminum foil) patch that was tightly taped in place below the rim. The shock tube samples immersed in the winterized diesel fuel were heated at 52° C. (125° F.) in a vented oven for predetermined intervals of time. After each interval of heating, samples were removed from the diesel fuel bath and initiated from a length of nominal 25 grains per foot ("gr/ft") detonating cord connected to the shock tube sample by means of a conventional J-hook connector. A failure was defined as the signal not being propagated past the length of tube which was immersed in the fuel mixture. The results were recorded as the time interval in hours of exposure to the heated winterized diesel fuel for which the tube will still shoot reliably from one end to the other after being initiated by the nominal 25 gr/ft detonating cord. Thus, the higher the time interval or number of hours of exposure, the better the results. A period of 28 hours in this accelerated oil immersion test is equal to about six weeks of field exposure in a commonly used emulsion explosive used in the United States. As shown in TABLE II, the three-ply reduced-diameter shock tube continued to function after 216 hours of continuous exposure whereas the three-ply standard diameter shock tube functioned after 12 hours of exposure but failed after 24 hours of exposure.

TABLE II

| | Reduced-Diameter Shock Tube | Comparative Standard Shock Tube |
|---|---|---|
| A. Tensile Strength (pounds at break) | 45 | 38 |
| Elongation (% at break) | 230 | 290 |
| B. Impact Resistance (cm) | 7.6 | 8.7 |
| C. Oil Permeation (hours to failure) | 216+ | <24 |

The results of TABLE II show that the smaller diameter three-layer tube manufactured with the same type of sub-tube resin but different tie-layer and over-jacket resins provides improved or equivalent performance in terms of tensile strength and elongation at break and impact resistance, as compared with conventional or larger shock tube.

The reduced-diameter shock tube of Example 2 can also be made at lower manufacturing cost than the standard size comparative shock tube of Example 2, because of its reduced materials requirement and higher extrusion rate.

EXAMPLE 3

In order to demonstrate the reduced migration of reactive material in the reduced-diameter signal transmission fuses of the present invention, the following tests were conducted. A number of ten-foot (3 meter) lengths of two-ply reduced-diameter shock tube in accordance with an embodiment of the present invention were weighed, the weights were recorded, and the lengths of tube were then affixed by means of retaining clips to a pole about ten and a half feet (3.2 meters) in length, the lengths of shock tube being maintained parallel to the longitudinal axis of the pole by the clips. In each case, the tube samples contained a reactive material comprising 10.5 percent by weight aluminum and 89.5 percent by weight HMX. The compositions of the plies of the samples tested for powder migration were as follows. (PRIMACOR, SURLYN and PEBAX are trademarks.)

| Sample No. | Innermost Ply[a] | Outermost Ply[b] |
|---|---|---|
| 1 | PRIMACOR Resin | Medium Density Polyethylene |
| 2 | SURLYN 8941 Resin | Medium Density Polyethylene |
| 3 | PRIMACOR Resin | Medium Density Polyethylene |
| 4 | SURLYN 8941 Resin | Medium Density Polyethylene |
| 5 | SURLYN 8941 Resin | PEBAX Resin |
| 8 | SURLYN 8941 Resin | PEBAX Resin |

[a] Corresponding to item 12 of FIGS. 1 and 2.
[b] Corresponding to item 14 of FIGS. 1 and 2.

The pole and therefore the lengths of shock tube were held in the vertical position and the bottom of each shock tube was closed with a small plastic bag. With a number of lengths of shock tube thus secured to the pole, the pole was maintained in a vertical position and raised about six inches above a concrete floor on which had been placed a shock absorbing pad comprising a piece of vinyl floor tile. The pole was allowed to drop from the six-inch height, raised six inches above the floor and repeatedly dropped again for a total of fifty repetitions. The resulting jarring dislodged some of the reactive material powder adhering to the inside of the lengths of shock tube resulting in an accumulation of the dislodged powder into the plastic bags affixed the lower ends of the tubes. After the fifty drops, the powder collected in each of the bags was separately weighed, as were the tubes, and the percentage of the original content of reactive material powder in the tubes which was dislodged by the test was calculated. The characteristics of each tube tested and the powder loss resulting from the test is set forth in TABLE III below.

TABLE III

| Sample | Shock Tube Dimensions[1] | | |
|---|---|---|---|
| No. | ID | OD | T |
| 1 | .029 in (0.734 mm) | .0845 in (2.146 mm) | .0275 in (0.699 mm) |
| 2 | .033 in (0.838 mm) | .0815 in (2.070 mm) | .0242 in (0.616 mm) |
| 3 | .035 in (0.889 mm) | .0820 in (2.083 mm) | .0235 in (0.597 mm) |
| 4 | .028 in (0.711 mm) | .0835 in (2.121 mm) | .0277 in (0.704 mm) |
| 5 | .028 in (0.711 mm) | .0830 in (2.108 mm) | .0275 in (0.699 mm) |
| 8 | .0345 in (0.876 mm) | 0.0840 in (2.134 mm) | .0247 in (0.627 mm) |

| | Reactive Material Content[2] | | Migration of Reactive Material |
|---|---|---|---|
| Sample No. | Core Load (mg/m) | PSD ($g/m^2$) | Powder Dislodged (%) |
| 1 | 11.8 | 5.1 | 0.7 |
| 2 | 11.2 | 4.25 | 8. |
| 3 | 12.3 | 4.40 | 7. |
| 4 | 12.4 | 5.55 | 11. |
| 5 | 11.4 | 5.10 | 11. |
| 8 | 11.3 | 4.10 | 3.8 |

[1]"in" = inch, "mm" = millimeter
[2]"Core load" and "PSD" are as defined above at the end of the section entitled "Summary of the Invention".

The results of TABLE III show that powder retention of the tested tubes is excellent and compares very favorably with powder losses from standard size, e.g., 0.118 in (3 mm) OD and 0.045 in (1.143 mm) ID standard size shock tube which, when subject to the same test as described above, characteristically demonstrates a powder migration loss of from about 10 to 40 percent, calculated as above.

While the invention has been described in detail with reference to specific embodiments thereof, it will be appreciated that numerous variations may be made to the specific embodiments which variations nonetheless lie within the scope of the appended claims.

What is claimed is:

1. A signal transmission fuse comprising:

a tube of synthetic polymeric material having a tube wall defining a tube outer surface and a tube inner surface, the tube inner surface defining a bore extending through the tube; and a reactive material dispersed within and extending along the length of the bore; wherein the tube has an outside diameter not greater than about 2.380 mm (0.0937 inch) and the ratio of the inside diameter of the tube to the thickness of the tube wall is from about 0.18 to 2.5.

2. The fuse of claim 1 wherein the tube has a tube outside diameter of from about 0.397 to 2.380 mm (about 0.0156 to 0.0937 inch) and a tube inside diameter of from about 0.198 to 1.321 mm (about 0.0078 to 0.052 inch).

3. The fuse of claim 2 wherein the ratio of the inside diameter of the tube to the thickness of the tube wall is from about 0.83 to 1.33.

4. The fuse of claim 2 or claim 3 wherein the tube outside diameter is from about 1.90 to 2.36 mm (about 0.075 to 0.093 inch) and the tube inside diameter is from about 0.50 to 0.86 mm (about 0.020 to 0.034 inch).

5. The fuse of claim 1 wherein the reactive material is a pulverulent mixture of aluminum and an explosive material selected from the class consisting of HMX, PETN, RDX, 2,6-bis(picrylamino)-3,5-dinitropyridine and ammonium perchlorate, and is dispersed within the bore at a powder surface density of from about 0.45 to 7 $g/m^2$.

6. The fuse of claim 5 wherein the reactive material comprises 75 to 95 parts by weight HMX and 25 to 5 parts by weight aluminum.

7. The fuse of claim 5 or claim 6 wherein the reactive material is dispersed within the bore at a powder surface density of less than about 2.7 $g/m^2$.

8. The fuse of claim 7 wherein the reactive material is dispersed within the bore at a powder surface density of from about 0.45 to 2.65 $g/m^2$.

9. The fuse of claim 6 wherein the reactive material is dispersed within the bore at a powder surface density of from about 1.4 to 7 $g/m^2$.

10. The fuse of claim 1 or claim 2 wherein the tube wall is comprised of a plurality of concentrically disposed sandwiched tubular plies, including an outermost ply having an outer wall which defines the tube outer surface and an innermost ply having an inner wall which defines the tube inner surface.

11. The fuse of claim 10 wherein the innermost ply comprises an ethylene acrylic acid polymer and the outermost ply comprises a polyether block amide polymer.

12. The fuse of claim 11 further comprising one or more intermediate plies sandwiched between the innermost ply and the outermost ply.

13. The fuse of claim 12 including an intermediate ply comprised of ethylene acrylic acid polymer.

14. The fuse of claim 10 wherein the innermost ply comprises an ionomer, the outermost ply comprises a polyether block amide polymer and the tube further comprises an intermediate ply which comprises an ethylene acrylic acid polymer.

15. The fuse of claim 10 further comprising a tie-layer which is in contact with both the inner and outer plies ("the bound plies") adjacent to it, and comprises a mixture of the polymers ("the bound ply polymers") of which the bound plies are respectively made, the tie-layer containing enough of each of the bound ply polymers so that the tie-layer adheres to each of the bound plies more strongly than it would if the bound ply polymers were not present in the tie-layer.

16. The fuse of claim 15 wherein the inner and outer plies respectively comprise the innermost and outermost plies of the fuse.

* * * * *

UNITED STATES PATENT AND TRADEMARK OFFICE

CERTIFICATE OF CORRECTION

PATENT NO. : 5,597,973
DATED : January 28, 1997
INVENTOR(S) : Ernest L. Gladden et al It is certified that error appears in the above-indentified patent and that said Letters Patent is hereby corrected as shown below:

In column 3, line 18, insert --or "PSD"-- after "powder surface density"; and
line 23, replace "terms" with --term--; and insert --or simply "core load"-- after "'linear core load'".

In column 4, line 52, replace "(2.388 mm)" with --(2.380 mm)--; and
line 60, insert --fuse-- after "signal transmission".

In column 6, line 29, insert --polymer-- after "acid".

In column 7, line 63, replace "recyled" with --recycled--.

In column 8, line 57, replace "2.11 mm" with --2.108 mm--.

In column 9, line 34, replace "reduced diameter" with --reduced-diameter--;
line 37, replace "(3.00 mm)" with --(2.997 mm)--; and
footnote 4 of TABLE I, insert an open parenthesis between "=" and "5.8".

In column 10, line 4, insert --125%-- after "wraps is";
line 41, replace "3 mm" with --2.997 mm--;
line 42, replace "1.14 mm" with --1.143 mm--;
line 49, replace "0.337" with --0.338--; and
line 61, replace "a Instron" with --an Instron--.

UNITED STATES PATENT AND TRADEMARK OFFICE

CERTIFICATE OF CORRECTION

PATENT NO. : 5,597,973
DATED : January 28, 1997
INVENTOR(S) : Ernest L. Gladden et al It is certified that error appears in the above-indentified patent and that said Letters Patent is hereby corrected as shown below:

In column 11, line 35, replace "reduced diameter" with --reduced-diameter--.

In column 13, TABLE III, Sample No. 5, column OD, replace ".0830" with --.083--.
line 41, replace "(3 mm)" with --(2.997 mm)--.

In column 14, claim 4, line 3, replace "0.50" with --0.51--; and
line 4, replace "0.86" with --0.864--.

Signed and Sealed this
Twentieth Day of October, 1998

Bruce Lehman

*Attest:*

BRUCE LEHMAN

*Attesting Officer*

*Commissioner of Patents and Trademarks*